United States Patent [19]

Brewer

[11] 4,425,772

[45] Jan. 17, 1984

[54] KEY LABELING SYSTEM

[76] Inventor: Robert A. Brewer, 15 Castle Park Way, Oakland, Calif. 94611

[21] Appl. No.: 306,709

[22] Filed: Sep. 29, 1981

[51] Int. Cl.[3] ..... A47G 29/10

[52] U.S. Cl. ..... 70/456 R

[58] Field of Search ..... 70/456 R, 456 B, 457, 70/458, 459; 24/3 D, 3 K, 27, 29, 230.5 W; 30/61, 62

[56] References Cited

U.S. PATENT DOCUMENTS

| | | | |
|---|---|---|---|
| 1,114,289 | 10/1914 | Rittenhouse | 70/459 |
| 1,647,140 | 11/1927 | Ludy | 70/459 |
| 2,677,954 | 5/1954 | Howell | 70/456 B |
| 3,009,350 | 11/1961 | Harper | 70/456 R |
| 3,181,321 | 5/1965 | Gits | 70/456 R |
| 3,715,900 | 2/1973 | Sherman | 70/456 R |

*Primary Examiner*—Robert L. Wolfe

*Attorney, Agent, or Firm*—James R. Cypher

[57] ABSTRACT

A system for labeling, filing and carrying keys consisting of a connector member formed from a single elongated metal wire formed with a loop at each end and having a planar mid-portion for the receipt of a resilient sleeve. The description of the key is typed or written on a paper label which is attached to the resilient sleeve. A clear plastic protective sheath may be attached to the paper label. The connectors with their attached keys are attached to a split metal ring.

1 Claim, 6 Drawing Figures

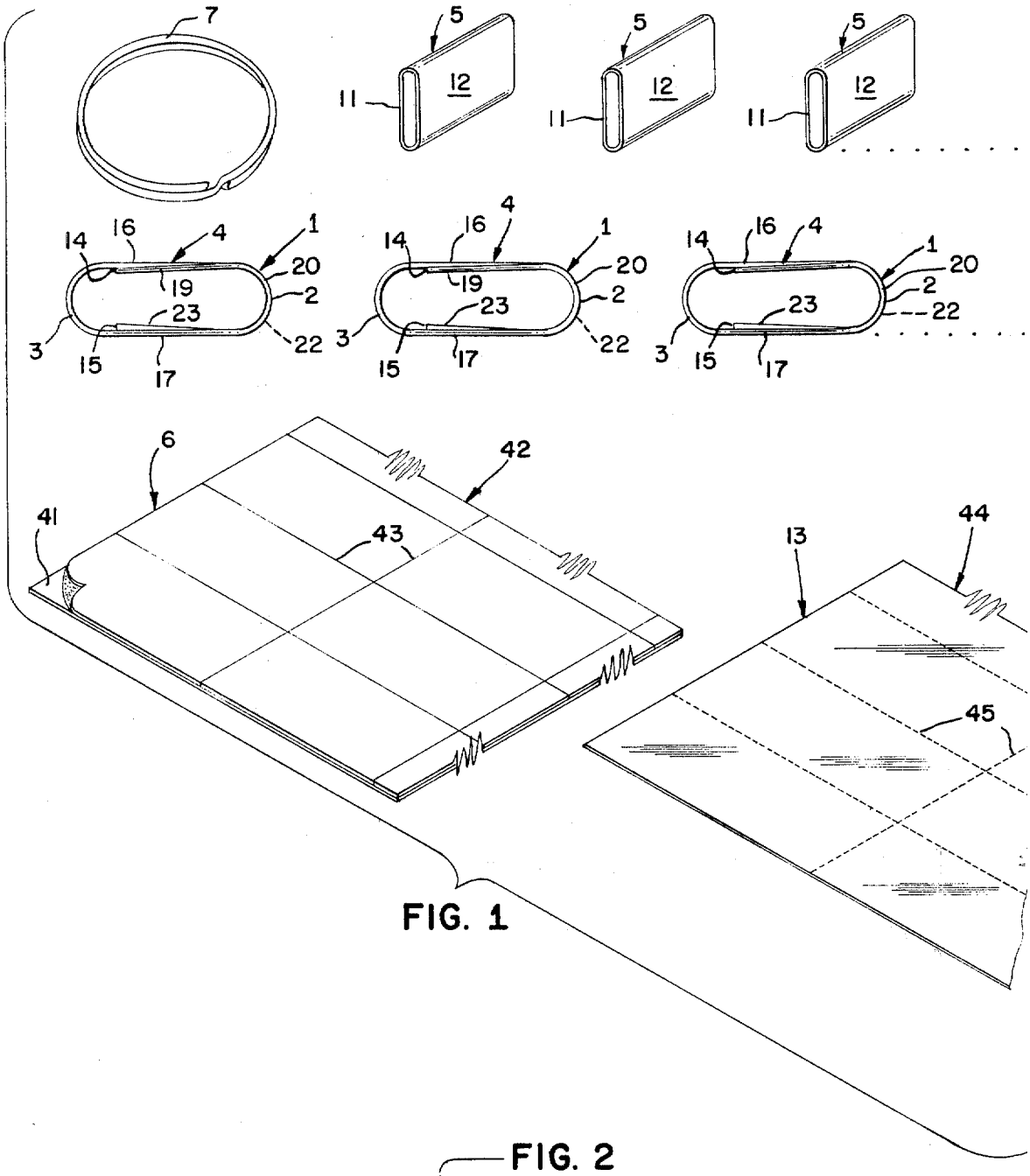
FIG. 1
FIG. 2
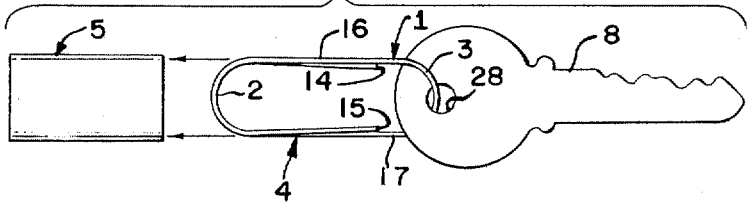
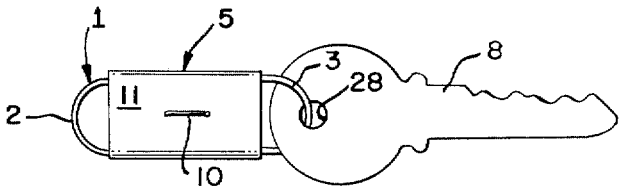
FIG. 3

KEY LABELING SYSTEM

BACKGROUND OF THE INVENTION

Until recent years, the ordinary householder carried only three or four keys; usually on a split ring or sometimes in a key case. Today, a householder may carry ten or more keys such as a house key, garage key, keys for two or more cars (trunk and ignition) security alarm key, office door key, lock box, luggage, ski or bicycle rack lock key and a miscellaneous key or two. Most people can remember which key fits which lock, but frequently the keys must be turned over to a relative or friend who is at a complete loss as to which key fits which lock. An apartment owner, hospital, school or business manager has an even more complicated problem since the number of their keys may number in the hundreds.

Usually, people store a duplicate set of keys in a safe place from which keys can be made should one or more keys be lost. Frequently, keys to seldom used lockers and pad locks for boats, summer cottages, luggage, equipment and other miscellaneous locks are stored. Here the problem is annoying since it is often difficult to remember which key fits which lock.

Present systems for labeling, storing and carrying keys are unnecessarily complex and yet limited in function. Some systems such as key rings are compact but labeling is difficult. Printed adhesive labels are available which can be used to identify certain keys, but not with the variety that a person may need to insure complete identification. Paper, plastic and metal tags are also available but these are either impermanent or hard to mark. Most of those available also have the disadvantage of being too bulky to carry in the pocket in large numbers. Many of them cannot be transferred easily from one key ring to another or to and from a hook in a cabinet or lock box. Some cannot be attached to a key ring or pocket key case.

SUMMARY OF THE INVENTION

The present key system consists of a unique connector which has a loop for attaching a key, a loop for attaching the key to a split ring, and an area for attaching a plastic sleeve which insures the separation of the key from the loop attached to the split ring as well as serving as a base for connecting the label identifying the particular key. A sheet of mylar is preferably furnished to protect the identifying label. All of the keys are then attached to a split ring in functional groupings. The plastic sleeves may be furnished in distinctive colors to further assist in the functional groupings of the keys. Different colored paper labels may also be used.

The significant feature of the present system is the fact that keys of all shapes and sizes may now be labeled, filed in a logical order, and then stored or carried. The keys remain instantly usable without removal of any labeling or disturbance of the filing sequence of the keys.

The labeling system does not significantly add to the bulk of the group of keys so that they may be easily carried in a compact form.

Duplicate keys are easily added or substracted from the unique connector or the entire set of keys on the unique connector may be added or removed from the split ring.

Identification of individual or sets of keys are easily changed or added at a later time.

Separation of individual keys from other keys on the unique connector is easily effected so that the keys may be used without removal either from the unique connector or the master split ring.

The connector assists in maintaining a separation between sets of keys so that the filed keys may be easily scanned and the desired key or group of keys selected for use or retrieval.

FIG. 1 is an exploded perspective view of a complete set of elements used in the present key system.

FIG. 2 is an exploded plan view of one form of the unique connector attached to a key prior to assembly of the sleeve member.

FIG. 3 shows the elements of FIG. 2 assembled.

DESCRIPTION OF THE PREFERRED EMBODIMENTS

Figure 4:
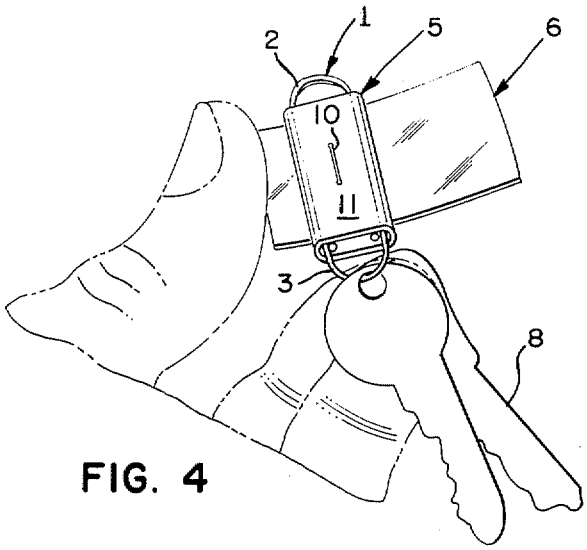
FIG. 4 is a perspective view showing a method of assembling the label on the sleeve member with keys attached and a partial view of the fingers of a hand.

The key system for labeling, filing and carrying keys consists of a connector member 1 formed from a single elongated metal wire having a generally closed shaped formed in a single plane and having a first loop 2 spaced from a second loop 3 joined by a planar mid-section 4. A resilient sleeve member 5 is removably affixed to the planar mid-section of the connector member. Indicia means 6 are provided and adapted for attachment to the resilient sleeve member. A metal split ring 7 is removably affixed to one of the spaced loops of the connector member. The other loop of the connector member is adapted for connection to a key 8.

Means such as a metal staple 10 may be used to join opposed sides 11 and 12 of the resilient sleeve member.

Preferably protective means such as a mylar sheet 13 may be used to cover the indicia means to protect obliteration of the identification.

A preferred connector is described in my patent U.S. Pat. No. 4,024,608 granted May 24, 1977. The connector consists briefly of:

A single wire having first and second ends 14 and 15 bent to a configuration lying generally within a single plane and consisting of a mid-portion 4 with generally straight and parallel portions 16 and 17. A single loop end 3 lies on one side of the mid-portion and a double loop end 2 on the other side of the mid-portion. An elongated, non-abrading, parallel sided sleeve member 5 is frictionally removably affixed and surrounds the wire and substantially covers the straight mid-portion and wire ends whereby one loop end is uncovered and is adapted for connection to a key and the sleeve separates the other loop end which is uncovered and adapted for connection to the split ring. The sleeve prevents the ends of the wire connector from snagging the inside of a pocket.

The wire member in FIGS. 1–5 consists of:

A first straight member 19 inclined inwardly of the mid-portion and terminates in a first distal end 14 within the mid-portion and adjacent to the single loop end. A first loop portion 2 is connected to the first straight portion and is bent on a curve of about 180° to form one of the loops of the double loop end. A second straight ember 17 is connected to the first loop portion on a ıe spaced from the first straight member. A second ·op 3 is connected to the second straight member and bent on a curve of about 180° and forms the single ›op end. A third straight member 16 is connected to ıe second loop and is spaced from and on a line con- ɜrgent to the second straight member 17 in a direction ›ward the first loop. A third loop 22 is connected to ıe third straight member 16 and generally overlies the rst loop member and is bent on a curve of about 180°. . fourth straight member 23 is inclined inwardly of the ıid-portion and terminates in a second distal end 14 ·ithin the mid-portion and is adjacent to the single loop ıd. The wire is bent so that the second and third raight members 17 and 16 converge slightly in the ırection of the double loop end 2 so that the first pe- meter distance at the junction of the first and third ›ops with the straight members is substantially equal to ıe second perimeter distance at the junction of the :cond loop with the straight members.

Figure 6:
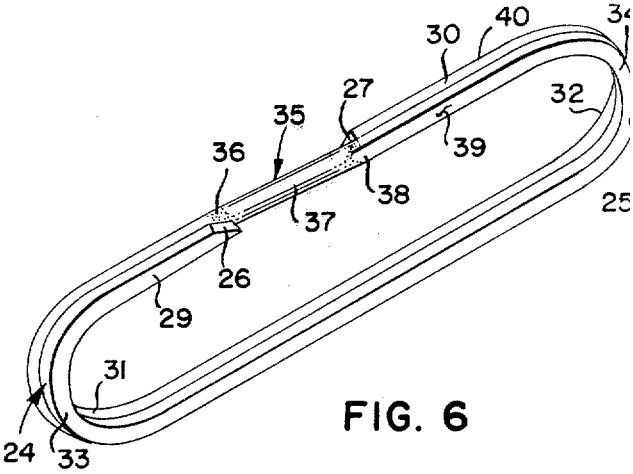
FIG. 6 is a perspective view of an alternate form of connector which may be used in the present system.

Another form of the connector is shown in FIG. 6. The elongated element is formed so that double loops 4 and 25 are formed at both ends.

The elongated element has ends 26 and 27 which are njoined so that the element may be threaded through ı opening 28 in a key. The ends, as shown, terminate in ıe straight portions 29 and 30 of the connector so as to ›rm continuous sections in the loop ends where the ɔnnector is attached to the key or split ring.

The connector is formed generally in one plane and ıe first end 26 terminates on a first side of the plane and ıe second end 27 terminates on the opposite face of the lane.

In order to reduce the overall thickness of the con- ector, loops 31 and 32 are formed on one level and ›ops 33 and 34 are formed on a second level in touch- ıg contact. Portion 35 of the elongated element is ›rmed as an offset, being formed with a bend 36, a :raight section 37 and a second bend 38 as shown in 'IG. 6. Ends 26 and 27 terminate approximately at ends 36 and 38 respectively.

In order to even further reduce the total thickness of ıe connector, the upper face 39 and lower face 40 of ıe elongated element may be flattened as illustrated. It ; unnecessary to flatten the offset portion 35 of the lement.

To enhance the appearance of the connector and/or ɔ protect the steel from corrosion, the element may be lated with nickel, cadmium, chromium, zinc, or other ıetal.

The sleeve member used with either of the described onnectors is preferably a plastic extruded tubular ıember. The sleeve covers the parallel sections of the onnector and performs several functions. First, the leeve prevents abrasion or scratching by the metal or y the sharp ends of the connector which terminate in he straight portion. The sleeve also prevents the con- ector from sliding through the opening in the key or plit ring and the connector can only pivot.

Preferably the sleeve is constructed from a material vhich has only limited stretch. The sleeve is dimen- ioned so that some stretching is required to slip it over he wire and the shape of the wire keeps the tube in ension to prevent it from sliding off. The selection of he material with only limited stretch holds the free nds 14 and 15 of the elongated member thereby trengthening the connector. Since the ability of the onnector to hold keys is limited, not by the tensile strength of the wire, but by the tendency of the wire to bend, spread and thereby release the keys, the use of the sleeve greatly enhances the ability of the connector to hold the keys.

Finally, the sleeve prevents the connector from working off of the key or split ring. When there is no covering or sleeve over the connector, it can sometimes work out of the key.

As shown in the drawing, the offset portion, as shown in FIG. 6 is longer than the offset portion of a standard split ring. The angle formed in the offset portion of the present invention is considerably less than the angle formed in split rings. The smaller angle in the wire results in a stronger connector since the wire need not be "upset" nearly as much.

The fact that the sleeve covers the sharp edges of the ends and the fact that the sleeve holds the ends together makes it possible to separate the ends at a greater distance and thereby eliminate the severe "upsetting" of the metal by a short offset portion with severe angles.

Use of the key system is as follows. Keys to be filed are divided into related groups of one to three and placed on a wire connector. The vinyl sleeve is then slid onto the connector from the end opposite the keys. A staple is then pressed through the center of the vinyl sleeve; making sure that the prongs are pressed down into the vinyl. The use of a staple is optional. The description of the key or some code is then written or typed on the paper labels. The paper label is then attached to the vinyl sleeve. Preferably the mylar protector sheet is then placed around the paper label with the ends lapping near the center of the flat part of the vinyl sleeve to minimize unraveling of the mylar sheet. The connectors are then attached to a split key ring.

Preferably, the paper labels carry an adhesive backing and are adhered to a releasable backing paper 41. A plurality of labels may be made from a single large paper sheet 42 with score lines 43 dividing individual labels which can be peeled off as needed. In like manner the mylar sheet 44 may be divided by score lines 45 for the removal of individual protective sheets 13.

Figure 5:
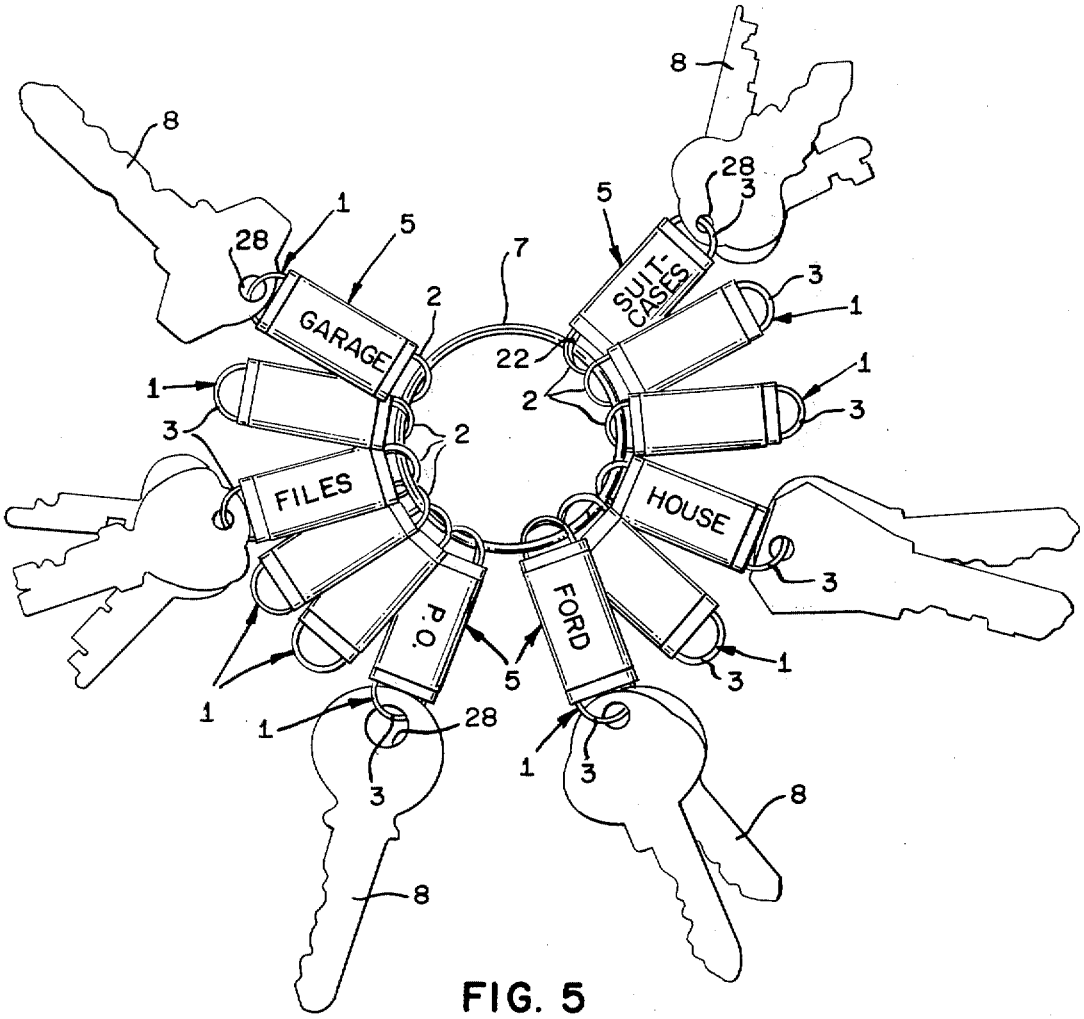
FIG. 5 is a plan view of the key system of the present invention.

Referring to FIG. 5, it may be seen that a single connector member 1 with its sleeve member and indicia means 6 may be removed from the split ring 7 and attached to another split ring without removing the sleeve member of the indicia means. Thus, if a weekend cabin key which was normally stored with other keys in a drawer was to be used, it is a simple matter to take the key, connector, sleeve and indicia means as a single unit; remove it from the split ring and place it on another key holding device and then carried for the weekend. At the end of the weekend, the entire key, connector, sleeve and indicia means could be replaced on the split ring and stored for another long period of time without removing the connector, sleeve or indicia means from the key.

I claim:

1. A method of labeling, filing and carrying keys comprising:

a. selecting a connector member having:

1. a single wire having first and second ends, bent to a configuration lying generally within a single plane and consisting of a mid-portion with generally straight and parallel portions of said wire and a single loop end on one side of said mid-portion and a double loop end on the other side of said mid-portion;

2. said wire member consists of:

(1) a first straight member inclined inwardly of said mid-portion and terminating in a first distal end within said mid-portion and adjacent to said single loop end, (2) a first loop portion connected to said first straight portion bent on a curve of about 180° and forming one of said loops of said double loop end;

(3) a second straight member connected to said first loop portion on a line spaced from said first straight member, (4) a second loop connected to said second straight member bent on a curve of about 180° and forming said single loop end, (5) a third straight member connected to said second loop spaced from and on a line convergent to said second straight member in a direction toward said first loop, (6) a third loop connected to said third straight member genrally overlying said first loop member and bent on a curve of about 180°, (7) a fourth straight member inclined inwardly of said mid-portion and terminating in a second distal end within said mid-portion and adjacent to said single loop end; and said wire is bent so that said second and third straight members converge slightly in the direction of said double loop end so that the first perimeter distance at the junction of said first and third loops with said straight members is substantially equal to the second perimeter distance at the junction of said second loop with said straight members b. selecting an elongated, non-abrading, parallel sided sleeve member frictionally removably affixed and surrounding said wire and substantially covering said straight mid-portion and said wire ends whereby one loop end is uncovered and is adapted for connection to a key and the sleeve separates the other loop end which is uncovered and is adapted for connection to a split ring c. selecting indicia means adapted for attachment to said sleeve member;

d. selecting a split ring and releasably attaching said ring to said second loop portion of said connector member.

* * * * *